US010763022B2

(12) United States Patent
Suzuki et al.

(10) Patent No.: US 10,763,022 B2
(45) Date of Patent: Sep. 1, 2020

(54) ELECTROMAGNETIC ACTUATING APPARATUS WITH A D-SHAPED COIL FOR A TWO-PIN ACTUATOR

(71) Applicant: Kendrion (Villingen) GmbH, Villingen-Schwenningen (DE)

(72) Inventors: Tsuneo Suzuki, Mönchweiler (DE); Michael Tischtschenko, Trossingen (DE); Aleksandra Lech, Villingen-Schwenningen (DE)

(73) Assignee: Kendrion (Villingen) GmbH, Villingen-Schwenninge (DE)

( * ) Notice: Subject to any disclaimer, the term of this patent is extended or adjusted under 35 U.S.C. 154(b) by 152 days.

(21) Appl. No.: 16/091,454

(22) PCT Filed: Apr. 21, 2017

(86) PCT No.: PCT/EP2017/059566
§ 371 (c)(1),
(2) Date: Oct. 4, 2018

(87) PCT Pub. No.: WO2017/186600
PCT Pub. Date: Nov. 2, 2017

(65) Prior Publication Data

US 2019/0156981 A1 May 23, 2019

(30) Foreign Application Priority Data

Apr. 25, 2016 (DE) ..... 10 2016 107 661

(51) Int. Cl.
*H01F 7/00* (2006.01)
*H01F 7/16* (2006.01)
(Continued)

(52) U.S. Cl.
CPC ..... *H01F 7/1607* (2013.01); *F01L 13/0015* (2013.01); *F01L 13/0036* (2013.01);
(Continued)

(58) Field of Classification Search
CPC ..... H01F 7/1607; H01F 7/081; H01F 27/006; F01L 13/0015
(Continued)

(56) References Cited

U.S. PATENT DOCUMENTS 2,916,584 A * 12/1959 Molyneux ..... H01H 51/01 335/166
3,040,145 A * 6/1962 Horman ..... H01H 50/30 335/119
(Continued)

FOREIGN PATENT DOCUMENTS

DE 102 40 774 4/2003
DE 10 2009 0015 86 9/2010
(Continued)

OTHER PUBLICATIONS

World Intellectual Property Organization, "International Search Report," and English translation thereof, issued in PCT/EP2017/059566, dated Aug. 8, 2017, document of 8 pages.
(Continued)

*Primary Examiner* — Shawki S Ismail
*Assistant Examiner* — Lisa N Homza
(74) *Attorney, Agent, or Firm* — Akerman LLP; Peter A. Chiabotti

(57) ABSTRACT

An actuating apparatus having a first actuating unit and a second actuating unit arranged adjacent to the first actuating unit. The actuating units each have elongated tubular coil bodies, actuator coils which are wound around the coil bodies, electromagnetically actuatable actuators which are guided in the coil bodies and are movable relative to the actuator coils, and the coil bodies are D-shaped and face one another with the flattened sides thereof.

15 Claims, 2 Drawing Sheets

(51) Int. Cl.
*H01F 27/00* (2006.01)
*F01L 13/00* (2006.01)
*H01F 7/08* (2006.01)

(52) U.S. Cl.
CPC ..... *H01F 7/081* (2013.01); *H01F 27/006* (2013.01); *F01L 2013/0052* (2013.01); *F01L 2013/101* (2013.01); *H01F 2007/086* (2013.01)

(58) Field of Classification Search
USPC ..... 335/267
See application file for complete search history.

(56) References Cited

U.S. PATENT DOCUMENTS 4,216,454 A * 8/1980 Ohtani ..... H01F 7/1607 335/236
4,250,477 A * 2/1981 Graninger ..... H01H 50/545 335/169
4,503,411 A * 3/1985 Lofstrand ..... H01F 7/1607 335/259
4,617,546 A * 10/1986 Kellogg ..... H01H 51/2209 335/170
4,641,072 A * 2/1987 Cummins ..... H01F 7/13 310/12.24
4,905,961 A * 3/1990 Ichihashi ..... H01F 7/1607 251/129.08
4,999,531 A * 3/1991 Mavadia ..... H01F 7/145 310/23
5,181,003 A * 1/1993 Yamashita ..... H01F 7/06 335/255
5,260,676 A * 11/1993 Patel ..... H01H 71/1009 335/132
RE34,870 E * 3/1995 Cummins ..... H01F 7/13 310/12.01
5,507,197 A * 4/1996 Devaud ..... F16H 61/2807 477/138
5,739,599 A * 4/1998 Murai ..... H01F 7/081 310/14
5,845,672 A * 12/1998 Reuter ..... B60T 8/3675 137/315.03
6,223,617 B1 * 5/2001 Tischer ..... F16H 61/30 74/335
6,414,406 B1 * 7/2002 Ikoma ..... H01F 7/081 310/14
6,420,949 B1 * 7/2002 Umemoto ..... F01L 9/04 335/251
6,433,662 B1 * 8/2002 Ikoma ..... H01F 7/1638 251/129.15
6,460,521 B1 * 10/2002 Modien ..... F16K 31/0655 123/568.21
6,823,757 B2 * 11/2004 Kobayashi ..... F16H 61/32 335/266
6,853,100 B2 * 2/2005 Yumita ..... F04B 17/042 310/12.24
7,053,741 B2 * 5/2006 Tojo ..... F02M 61/168 335/220
7,157,996 B2 * 1/2007 Enomoto ..... H01H 50/02 335/126
7,222,554 B2 * 5/2007 Hayashi ..... F16H 61/32 335/266
7,288,861 B1 * 10/2007 Willard ..... H02K 41/0356 310/14
7,992,848 B2 * 8/2011 Kon ..... F16F 13/264 267/140.14
8,436,704 B1 * 5/2013 Venkataraghavan ..... H01F 3/08 251/129.15
2002/0125974 A1 * 9/2002 Cage ..... H01F 7/081 335/220
2002/0135447 A1 * 9/2002 Gruner ..... H01H 51/2209 335/132
2002/0158727 A1 * 10/2002 Namen ..... E05B 47/026 335/78
2004/0084649 A1 5/2004 Yoshimura et al.
2004/0201441 A1 10/2004 Elendt et al.
2007/0063795 A1 * 3/2007 Kon ..... F16F 13/268 335/2
2007/0210653 A1 * 9/2007 Scanlon ..... H01F 7/1615 310/15
2009/0039992 A1 * 2/2009 Ryuen ..... H01F 7/081 335/255
2009/0256664 A1 * 10/2009 Rane ..... H01H 71/2463 335/258
2009/0319010 A1 12/2009 Hirayama et al.
2011/0057753 A1 * 3/2011 Irwin ..... H01F 7/088 335/257
2012/0154079 A1 * 6/2012 Sasao ..... H01F 7/128 335/278
2012/0262259 A1 * 10/2012 Teo ..... H02K 16/00 335/296
2013/0255607 A1 3/2013 Schuler
2015/0279538 A1 * 10/2015 Toda ..... H01F 16/00 335/296

FOREIGN PATENT DOCUMENTS

DE 10 2010 005 071 7/2011
DE 10 2011 003760 5/2012
DE 10 2013 206 311 11/2013
DE 10 2014 205101 9/2015

OTHER PUBLICATIONS

German Patent Office, "Office Action" issued in German Patent Application No. 10 2016 107 661.9, dated Feb. 9, 2017, document of 14 pages.

* cited by examiner

ELECTROMAGNETIC ACTUATING APPARATUS WITH A D-SHAPED COIL FOR A TWO-PIN ACTUATOR

CROSS REFERENCE TO RELATED APPLICATIONS

This application is a § 371 National Phase of PCT/EP2017/059566, filed Apr. 21, 2017, the entirety of which is incorporated by reference and which claims priority to German Patent Application No. 10 2016 107 661.9, filed Apr. 25, 2016.

BACKGROUND

This application relates to an actuating device, particularly a cam shaft actuating device having the features and structures described herein.

SUMMARY

Actuating apparatuses having electromagnetically actuatable actuator units comprising actuating elements with end-side engaging surfaces for axially adjusting the engaging surface in a first direction, as well as resetting units for resetting the engaging surface into a second direction which is opposite to said first direction, are for example known from DE 102 40 774 A1 and are used for various applications, for example as cam shaft actuating apparatuses in motor vehicles. The basic principle of these known actuating apparatuses is that a piston as the actuating element, which comprises an engaging area for the intended actuating task on its end sides, is guided in a housing and can be moved out of the housing against the force of a resetting spring using an electromagnetically actuatable actuator unit provided in the housing.

Also known are valve lift adjusting apparatuses, which can change a position of a sliding member which rotates together with the cam shaft and moves axially relative to the cam shaft. Valve lift adjusting apparatuses coordinate lift amounts of inlet valves and outlet valves of an internal combustion engine. In vehicles, for example, drivers can switch from a sporty to a fuel-efficient driving style by toggling a switch.

An electromagnetic actuator is used for changing the position of the sliding member. This actuator alternatively moves one of two control pins in accordance with a direction of movement of the sliding member, such that a tip of the control pin is brought into engagement with an engaging groove formed in the sliding member. DE 10 2009 015 86 A1, for example, discloses such an electromagnetic actuator having two control pins. A permanent magnet is provided on one base end of each control pin. The polarity of the permanent magnets is opposite to each other in a direction of movement of the control pins. When a coil is excited to generate a magnetic field, a repulsive force is generated in one of the permanent magnets and an attractive force is generated in the other permanent magnet.

This moves the control pin with the permanent magnet that generates the repulsive force. When the excitation direction of the coil is changed, a magnetic flux direction of the magnetic field becomes the opposite direction, such that the other control pin is moved.

To generate a repulsive force that is sufficiently great to improve the response rate of the control pins, the coil and the permanent magnet must be respectively larger. Furthermore, since the permanent magnet moves together with the control pins, the weight of one of the moving elements increases when the permanent magnet is dimensioned larger, and the coil must generate a greater electromagnetic force.

DE 10 2013 206 311 A1 discloses an invention in which an electromagnetic actuator is provided which can improve a response rate of a control pin. For this purpose, an electromagnetic actuator is applied to a valve lift adjusting apparatus, which adjusts a lift amount of an inlet valve or an outlet valve of an internal combustion engine. Two control pins arranged adjacent to each other are energized by a single coil, which is conducted around both control pins. Two permanent magnets, each located at a base end of the control pin, ensure that, when the coil is energized, either the one control pin or the other control pin is moved downwards towards the cam shaft, depending on the polarity of the energization. It is a disadvantage of this arrangement that thick and massive permanent magnets must be provided in the electromagnetic actuator to achieve a sufficient response rate of the control pins. The exciter coil must also be thick and massive, which additionally increases the weight of the electromagnetic actuator. If one wants to work with electromagnetic actuators of lower weight, each control pin must be given its own exciter coil, which increases the spacing between the two control pins quite considerably. This again requires a wider valve lift adjusting apparatus.

This is where the present application comes into play.

The present application provides an electromagnetic actuator whose response rate is very high and which comprises two control pins which should be spaced apart as little as possible.

An actuating apparatus having the features and structures recited herein is disclosed. Advantageous embodiments are disclosed herein.

This is achieved by an actuating apparatus having a first actuating unit and a second actuating unit arranged adjacent to the first actuating unit. The actuating units each comprise elongated tubular coil bodies, actuator coils, which are wound around the coil bodies, and electromagnetically actuatable actuators, which are guided in the coil bodies and are movable relative to the actuator coils. The coil bodies are D-shaped and face one an other with the flattened sides thereof.

In detail, the actuating apparatus according to the present application, comprises a first actuating unit having a first elongated tubular coil body, a first actuator coil, which is wound around the first coil body, and a first actuator which can be electromagnetically actuated by the first actuator coil, which actuator is guided in the first coil body and movable relative to the first actuator coil. The actuating apparatus further comprises a second actuating unit arranged adjacent to the first actuating unit, having a second elongated tubular coil body, a second actuator coil, which is wound around the second coil body, and a second actuator which can be electromagnetically actuated by the second actuator coil, which actuator is guided in the second coil body and movable relative to the second actuator coil. According to the present application, the first actuator coil comprises an outer solid peripheral line with an arcuate section and a straight section configured as a chord along at least one section of its longitudinal axis and in cross section perpendicular to its longitudinal axis. The first coil body thus has a D-shaped structure. A reduction of the spacing between the first actuator and the second actuator, that is, a reduction of the spacing of the two control pins apart from one another, can be achieved by this measure alone.

The longitudinal axis of the first coil body and the longitudinal axis of the second coil body, or the axes of the two directions of movement of the two actuators, respectively, are advantageously oriented parallel to one another.

The spacing of the two actuators relative to one another can further be reduced in that the second coil body also comprises an outer solid peripheral line with an arcuate section and a straight section configured as a chord along at least one section of its longitudinal axis and in cross section perpendicular to its longitudinal axis, wherein the two actuating units are preferably arranged relative to one another such that their sections configured as chords are facing one another.

The circular arc of the arcuate section advantageously has a center point angle of at least 120°, preferably between 180° and 300°.

It is preferred that the coil bodies have equal diameters, and advantageously equal sections in cross section. This means that both the arcuate sections and the straight sections configured as chords have the same dimensions.

The spacing of the actuators from one another can further be reduced in that the first actuator coil on the first actuating unit and the second actuator coil on the second actuating unit are arranged at an offset to one another. The first actuator coil and the second actuator coil are preferably wound in the same winding direction.

The first actuator coil and the second actuator coil are preferably electrically connected in series. In this way, a single control pulse can be used to energize the one actuator coil and the other actuator coil, such that, if the actuator coils are arranged at an offset, the one actuator is accelerated downwards while the other actuator is accelerated upwards, in the opposite direction.

A further reduction in the spacing of the two actuators relative to one another can be achieved in that the second actuator coil partially covers the first actuator coil of the first coil body in a viewing direction along the longitudinal axis of the first coil body.

The actuators preferably comprise an outer solid peripheral line at least along a section of their respective longitudinal axes and in cross section perpendicular to their longitudinal axes, which peripheral line has an arcuate section and a straight section configured as a chord, wherein the sections configured as chords are preferably facing one another. The two actuating units can be controlled selectively or jointly, wherein the actuator are oriented substantially axially parallel to one another.

Actuating apparatuses of the type described herein can for example be used as cam shaft actuating apparatuses.

BRIEF DESCRIPTION OF THE DRAWINGS

The actuating apparatus according to the present application is explained in greater detail below with reference to specific embodiments. Wherein.

DETAILED DESCRIPTION

Figure 1:
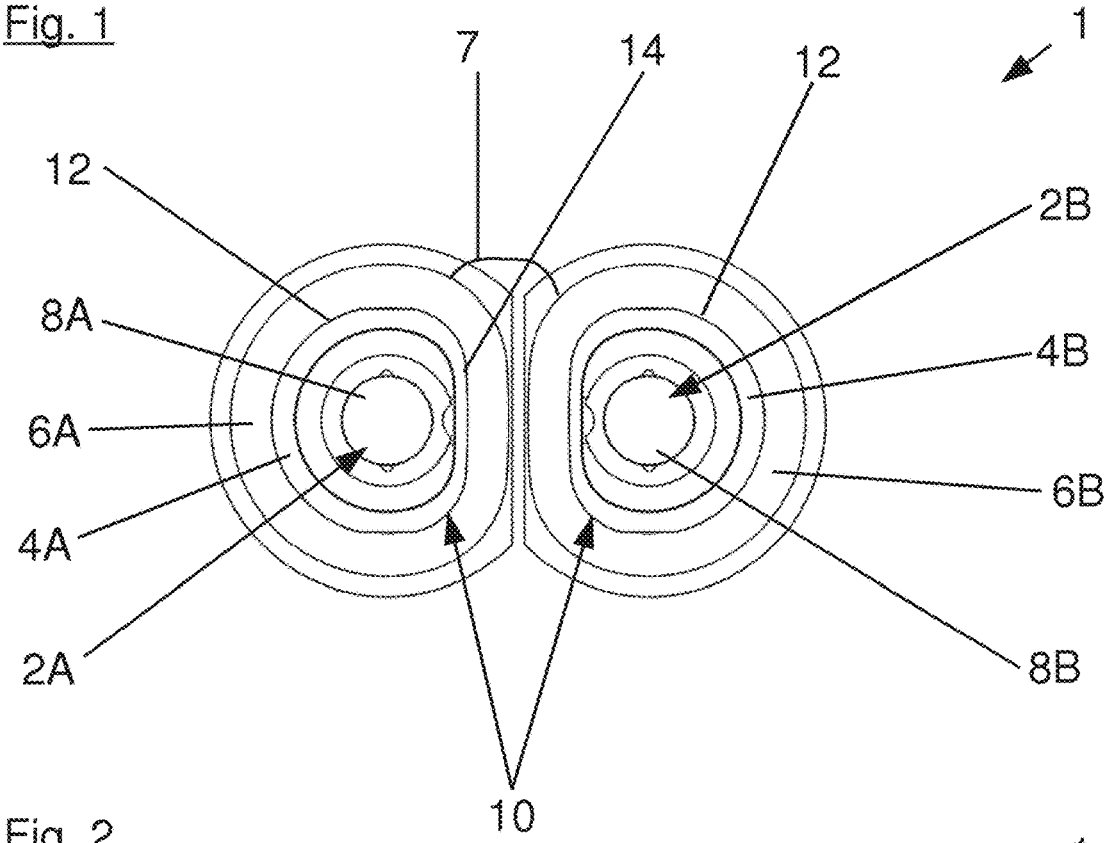
FIG. 1 shows a top view of an actuating apparatus in the direction of the two longitudinal axes of the coil bodies.

FIG. 1 shows an actuating apparatus 1 having a first actuating unit 2*a* and a second actuating unit 2*b*. The first actuating unit 2*a* comprises a first coil body 4*a*, the second actuating unit 2*b* comprises a second coil body 4*b*. A first actuator coil 6*a* is wound onto the first coil body 4*a*. A second actuator coil 6*b* is wound onto the second coil body 4*b*. The actuator coils 6*a* and 6*b* can be connected via electrical connecting lines 7. For example, a specific number of windings, for example four windings, can initially be applied onto the coil body 4*a* and for example form the first actuator coil 6*a*. At the end of these windings, the actuator coil 6*a* can be continued on the second coil body 4*b*, for example by also winding four windings onto the second coil body 4*b*, which then form the second actuator coil 6*b*. Another option is to conduct multiple windings around both coil bodies 4*a*, 4*b*, or fewer windings, but at least one winding. Another option is to alternately wind one or several windings around the first coil body 4*a*, then one of several around the second coil body 4*b*, then again one or several windings around the first coil body 4*a* and so on, such that the windings around the first coil body 4*a* form the first actuator coil 6*a* and the windings around the second coil body 4*b* form the second actuator coil 6*b*.

The coil bodies 4*a*, 4*b* have a D-shaped structure and are directed toward one another or directed in opposition to one another with the flattened sides thereof. Actuators 8*a*, 8*b* are arranged in the interior of the coil bodies 4*a*. 4*b* and movably guided along the longitudinal axes of the coil bodies 4*a*, 4*b*.

The coil bodies 4*a*, 4*b* each comprise outer peripheral lines 10, each having an arcuate section 12 and a straight section 14. The straight sections 14 of the two coil bodies 4*a*, 4*b* are oriented in this example such that they face one another. The first actuator 8*a* and the second actuator 8*b* have a cylindrical design. The two actuators 8*a*, 8*b* can also be D-shaped like the coil bodies 4*a*, 4*b* and be directed in opposition to one another with the flattened sides thereof.

Figure 2:
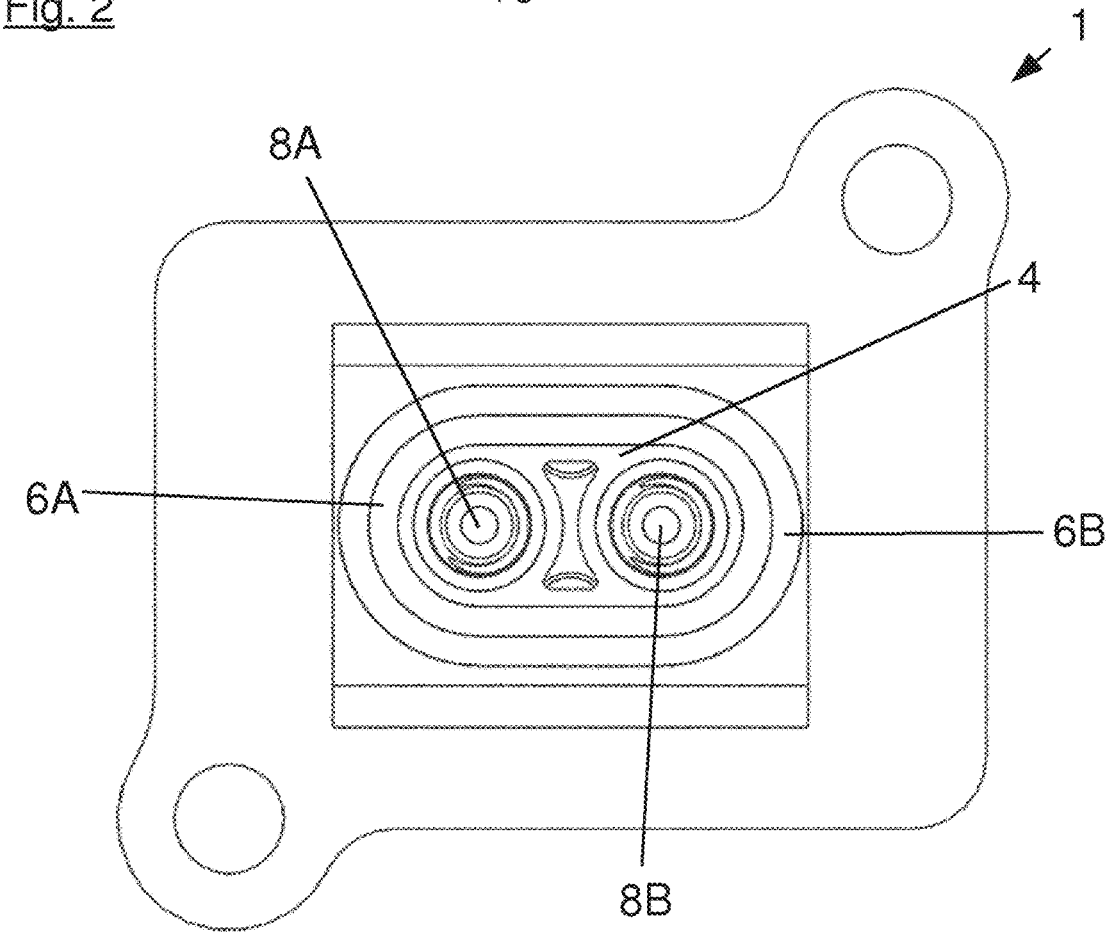
FIG. 2 shows the actuating apparatus of FIG. 1 in the same sectional view.

FIG. 2 shows another actuating apparatus 1. The coil bodies 4*a*, 4*b* are integrally formed into one coil body 4. The windings of the first actuator coil 6*a* and the windings of the second actuator coil 6*b* each orbit the two actuators 8*a*, 8*b* and can be arranged on top of one another or at an offset to one another on the coil body 4. The actuator coils 6*a* and 6*b* can be energized in opposite directions, such that the magnetic flux through the actuator coil 6*b* can neutralize the magnetic flux through actuator coil 6*a*.

Figure 3:
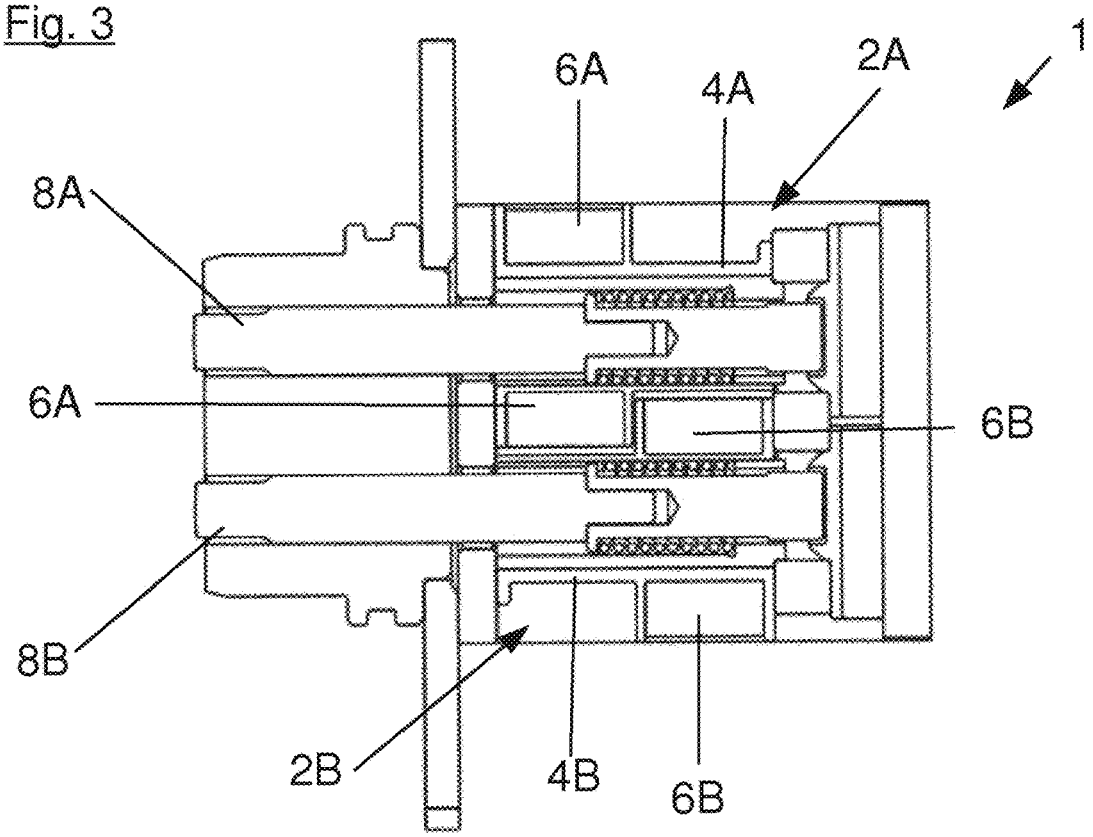
FIG. 3 shows a sectional view of a first embodiment of an actuating apparatus perpendicular to the top view along the longitudinal axes of the two coil bodies.

FIG. 3 shows a first embodiment of an actuating apparatus 1 having a first actuating unit 2*a* and a second actuating unit 2*b*. The first actuator coil 6*a* is in this case arranged at a spatial offset to the second actuator coil 6*b* in the actuating apparatus 1. The actuator coils 6*a*, 6*b*, which in this example may for example be wound in the same winding direction and electrically connected in series, partially cover one another in the viewing direction along the longitudinal axis of the first coil body 4*a*.

Figure 4:
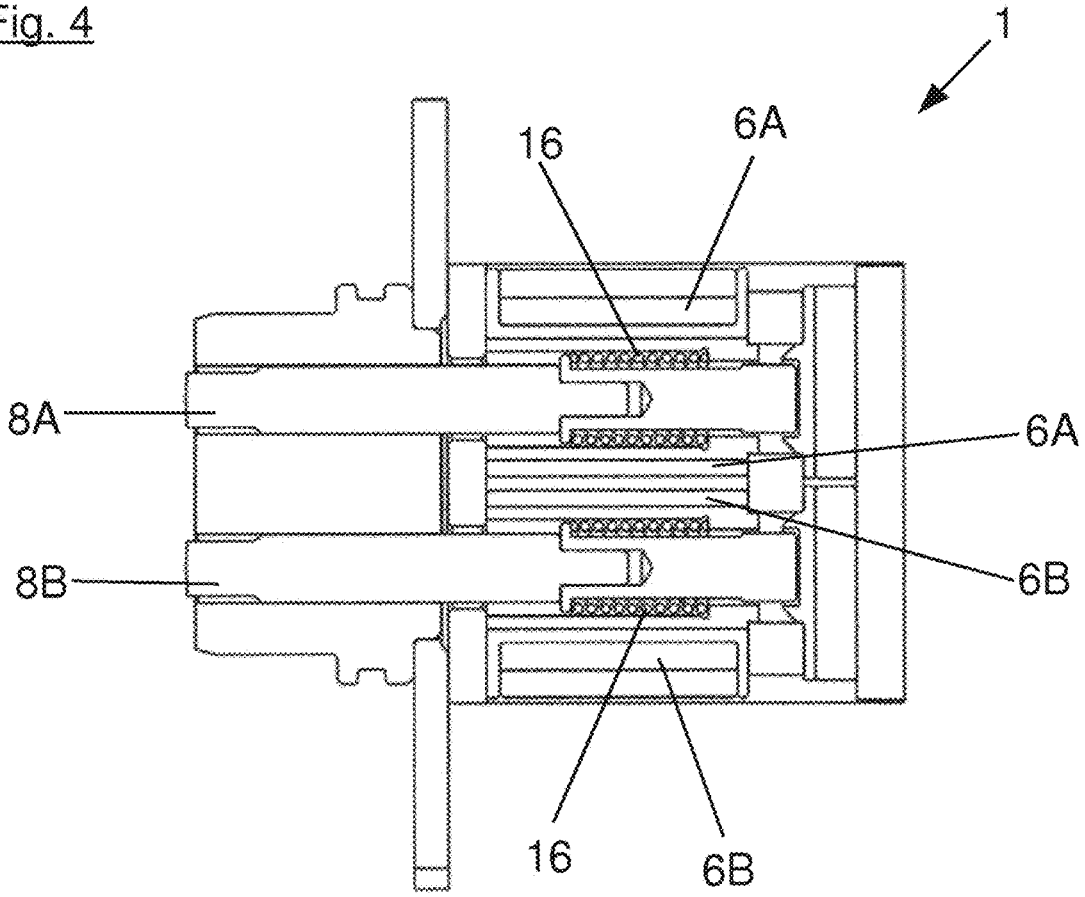
FIG. 4 shows a sectional view of a second embodiment of an actuating apparatus perpendicular to the top view along the longitudinal axes of the two coil bodies.

FIG. 4 shows a second embodiment of an actuating apparatus 1 having a first actuating unit 2*a* and a second actuating unit 2*b* along the longitudinal axes of the coil bodies 4*a*, 4*b*. In this embodiment, the two actuator coils 6*a* and 6*b* are arranged in parallel next to one another and not at an offset to one another. Resetting springs 16 ensure that the electromagnetically deflected actuators 8*a*, 8*b* are returned to their initial positions when the electric magnets 6*a*, 6*b* are no longer energized.

The present disclosure was explained with reference to two embodiments, without being limited to these embodiments. A person skilled in the art can conceive numerous modifications and designs of the apparatus according to the present disclosure without deviating from the inventive idea.

LIST OF REFERENCE SYMBOLS

1 actuating apparatus
2*a* first actuating unit
2*b* second actuating unit
4*a* first coil body
4*b* second coil body
4 coil body
6*a* first actuator coil
6*b* second actuator coil
7 electrical connecting lines
8*a* first actuator
8*b* second actuator
10 peripheral line
12 arcuate section
14 straight section
16 resetting springs

The invention claimed is:

1. An actuating apparatus, comprising:
a first actuating unit comprising:
a first elongated tubular coil body,
a first actuator coil, which is wound around the first elongated tubular coil body,
a first actuator that is electromagnetically actuated by the first actuator coil, which first actuator is guided in the first elongated tubular coil body and movable relative to the first actuator coil,
a second actuating unit arranged adjacent to the first actuating unit, the second actuating unit comprising:
a second elongated tubular coil body,
a second actuator coil, which is wound around the second coil body,
a second actuator that is electromagnetically actuated by the second actuator coil, which second actuator is guided in the second coil body and movable relative to the second actuator coil,
wherein the first actuator coil comprises an outer solid peripheral line with an arcuate section and a straight section configured as a chord along at least one section of a longitudinal axis of the first actuator coil and in cross section perpendicular to the longitudinal axis.

2. The actuating apparatus according to claim 1, wherein the longitudinal axis of the first coil body and a longitudinal axis of the second coil body are oriented parallel to one another.

3. The actuating apparatus according to claim 1, wherein the second actuator coil comprises an outer solid peripheral line with an arcuate section and a straight section configured as a chord along at least one section of a longitudinal axis and in cross section perpendicular to the longitudinal axis.

4. The actuating apparatus according to claim 1, wherein the circular arc of the arcuate section has a center point angle of at least 120 degrees.

5. The actuating apparatus according to claim 3, wherein the first actuating unit and the second actuating unit are arranged relative to one another such that their straight sections configured as chords are facing one another.

6. The actuating apparatus according to claim 1, wherein the first actuator coil on the first actuating unit and the second actuator coil on the second actuating unit are arranged at an offset from one another.

7. The actuating apparatus according to claim 1, wherein the first actuator coil and the second actuator coil are wound in the same winding direction.

8. The actuating apparatus according to claim 1, wherein the first actuator coil and the second actuator coil are electrically connected in series.

9. The actuating apparatus according to claim 1, wherein the first actuator and the second actuator comprise an outer solid peripheral line at least along a section of their respective longitudinal axes and in cross section perpendicular to their longitudinal axes, which peripheral line has an arcuate section and a straight section configured as a chord, wherein the sections configured as chords are preferably oriented facing one another.

10. The actuating apparatus according to claim 1, wherein the first actuating unit and the second actuating unit are controlled selectively, wherein the first actuator and the second actuator are substantially oriented axially parallel to one another.

11. A cam shaft adjusting apparatus, comprising at least one actuating apparatus according to claim 1.

12. An actuating apparatus, comprising:
a first actuating unit comprising:
a first coil body;
a first actuator coil having a first actuator coil longitudinal axis, wherein the first actuator coil is wound around the first coil body;
a first actuator that is electromagnetically actuated by the first actuator coil, wherein the first actuator is guided in the first coil body and movable relative to the first actuator coil;
wherein the first actuator coil comprises an first arcuate section and a first straight section configured as a first chord along at least one section of first actuator coil longitudinal axis and in cross section perpendicular to the first actuator coil longitudinal axis;
a second actuating unit arranged adjacent to the first actuating unit, the second actuating unit comprising:
a second coil body;
a second actuator coil having a second actuator coil longitudinal axis, wherein the second actuator coil is wound around the second coil body;
a second actuator that is electromagnetically actuated by the second actuator coil, wherein the second actuator is guided in the second coil body and movable relative to the second actuator coil;
wherein the second actuator coil comprises a second arcuate section and a second straight section configured as a second chord along at least one section of second actuator coil longitudinal axis and in cross section perpendicular to the second actuator coil longitudinal axis; and
the first actuator coil longitudinal axis is parallel to the second actuator coil longitudinal axis.

13. The actuating apparatus according to claim 12, wherein the circular arc of the arcuate section has a center point angle of at least 120 degrees.

14. The actuating apparatus according to claim 12, wherein the circular arc of the arcuate section has a center point angle of between 180 degrees and 300 degrees.

15. The actuating apparatus according to claim 12, wherein the first actuating unit and the second actuating unit are arranged relative to one another such that the first straight section configured as a first chord is facing the second straight section configured as a second chord.

* * * * *